United States Patent [19]

Riehm et al.

[11] Patent Number: 4,699,728

[45] Date of Patent: Oct. 13, 1987

[54] AQUEOUS ACIDIC COMPOSITION FOR CLEANING FIBERGLASS

[75] Inventors: Terri L. Riehm, Bloomington; Robert T. Hall, II, Welch, both of Minn.

[73] Assignee: Ecolab, Inc., St. Paul, Minn.

[21] Appl. No.: 868,425

[22] Filed: May 29, 1986

[51] Int. Cl.[4] ..... C11D 11/08; C11D 17/00

[52] U.S. Cl. ..... 252/142; 252/545; 252/546; 252/174.24; 252/DIG. 14

[58] Field of Search ..... 252/142, 545, 546, 174.24, 252/DIG. 14

[56] References Cited

U.S. PATENT DOCUMENTS

| | | |
|---|---|---|
| 3,591,509 | 7/1971 | Parks et al. . |
| 3,689,436 | 9/1972 | Stamm et al. . |
| 3,755,559 | 8/1973 | Hewitt . |
| 4,372,869 | 2/1983 | Lindemann et al. . |

OTHER PUBLICATIONS

Monsanto's Technical Bulletin, I-247, "Dequest Phosphorus-based Compounds".

Monsanto's Technical Bulletin, No. IC/SCS-320, "Dequest 2000 and 2006 Phosphonates for Scale and Corrosion Control Chelation, Dispersion".

Philip A. Hunt Chemical Corporation Product Information, "Wayplex 45-A".

Philip A. Hunt Chemical Corporation Product Information, "Wayplex 55-A".

Good-rite Chemicals, "Good-rite K-700 Polyacrylates".

Good-rite Chemicals, Product Information, "Good-rite K-XP78 Sodium Polyacrylate".

Mona Industries Product Bulletin, "Amphoterics".

Mobay Product Information, "Bayhibit AM, Properties, Effects, Applications of the Mobay Phosphonate".

*Primary Examiner*—Josephine L. Barr

*Attorney, Agent, or Firm*—Merchant, Gould, Smith, Edell, Welter & Schmidt

[57] ABSTRACT

An aqueous acidic solution for cleaning fiberglass without significant discoloration of the surface thereof comprising a water-soluble organophosphonic acid and/or a water soluble acrylic acid polymer, in combination with a higher (alkyl)betaine surfactant and, optionally an amount of alkaline pH modifying substance effective to adjust the pH to a value within the range of about 3.0-7.0. The preferred (alkyl)betaine is lauramidopropyl betaine. Cleaning results are optimized when the acrylic polymer and organophosphate are combined in a cleaning composition having a pH of about 3.5-4.5.

27 Claims, No Drawings

AQUEOUS ACIDIC COMPOSITION FOR CLEANING FIBERGLASS

FIELD OF THE INVENTION

The present invention relates to aqueous acidic compositions for cleaning fiberglass, which include a water soluble organophosphate and/or a water-soluble acrylic polymer together with a higher alkylbetaine surfactant.

BACKGROUND OF THE INVENTION

Currently, a number of compositions for cleaning plastic surfaces, particularly fiberglass, are commercially available. Existing cleaners are of two general types: spray-on foam type cleaners; and petroleum based glazes.

The foam type cleaners include both general home bathroom cleaners as well as more heavy duty cleaning compositions designed for institutional or industrial use. Many of the available home bathroom cleaners do not adequately clean fiberglass surfaces. Further, many home bathroom cleaners can discolor the fiberglass. Although heavy duty foaming cleaners exhibit better cleaning characteristics, these cleaners can also cause a significant amount of surface discoloration when applied to plastic surfaces.

The commercially available fiberglass cleaners also include petroleum based glazes. In general, petroleum based glazes are applied to fiberglass surfaces and are allowed to dry. After a specified period of time the dried glaze is wiped off the cleaned fiberglass surface. Unfortunately, petroleum based glazes produce numerous vaporous petroleum distillates which limit the use of this type of cleaner in enclosed areas such as bathrooms. These vaporous distillates are volatile and are potentially harmful if inhaled in excessive amounts.

Therefore, a need exists for an effective fiberglass cleaning composition which does not discolor fiberglass and which is safe to use in a variety of cleaning environments, including home use.

BRIEF SUMMARY OF THE INVENTION

The present invention is directed to an aqueous acidic fiberglass cleaning composition comprising water, a water-soluble organophosphonic acid and/or a water-soluble acrylic acid polymer, a higher (alkyl)betaine surfactant and, optionally, an alkaline pH modifying substance in an amount sufficient to adjust the pH of the composition to within a range of about 3.0–7-0. The preferred alkylbetaine is lauramidopropyl betaine which can be used in the acidic cleaning compositions at the preferred pH of about 3.5–4.5.

We have found that the aqueous acidic fiberglass cleaning solution of the present invention provide effective cleaning. In preferred embodiments of the present invention, cleaning ability is enhanced when about 0.5% to 10% of the water-soluble organophosphonic acid and about 0.5% to 10% of the water-soluble acrylic acid polymer are employed in substantially equal amounts (i.e. about 1:1). Further, use of the fiberglass cleaning solutions of the present invention results in negligible, if any, discoloration of the cleaned fiberglass surface. The surprising lack of surface discoloration is apparently due to the use of a higher molecular weight phosphorous acid sequestrant and/or a polymeric acid sequestrant in combination with an amphoteric surfactant to decrease the binding and penetration of the cleaner into the surface.

DETAILED DISCUSSION OF THE INVENTION

The aqueous fiberglass cleaning compositions of the present invention are formed from a water-soluble organophosphonate and/or a water-soluble acrylic polymer, a higher (alky)betaine surfactant, water, and, optionally, an amount of a pH modifying substance in an amount effective to adjust the pH of the solution to about 3.0–7.0.

The present compositions will include an amount of a water-soluble organic phosphonic acid and/or acrylic acid polymer effective to remove scum and hard water deposits. A number of organophosphates capable of dispersing soil and dirt particles and complexing hardness factors (i.e., the ions of calcium, copper, magnesium, etc.) present in hard water and detergent formulations are commercially available. These include: aminotri(methylene phosphonic acid) available from Monsanto Industrial Chemicals Co., St. Louis, Mo. as Dequest® 2000; 1-hydroxyethylidene-1,1-diphosphonic acid available from Monsanto as Dequest® 2041; and diethylene triaminepenta-(methylene phosphonic acid), available from Monsanto as Dequest® 2060. These phosphonic acids can be employed at a concentration of about 0.25–15% of the present compositions. A preferred organic phosphonic acid in the present invention formulation is aminotri(methylene phosphonic acid), (Dequest® 2000) which is preferably employed at a level of about 0.5% to 10% by weight of the present compositions.

Fiberglass cleaning compositions were formulated in which the pentasodium salt of aminotri(methylene phosphonic acid) was included in place of Dequest® 2000; however, these cleaning formulations exhibited inferior removal of soap scum and hard water deposits when compared to the cleaning formulations containing Dequest® 2000.

The present composition can also incorporate a water-soluble acrylic polymer in place of or in combination with the organophosphonic acid component.

Acrylate polymers which can be employed in the present compositions include polyacrylic acid, polymethacrylic acid, acrylic acid-methacrylic acid copolymers, hydrolyzed polyacrylamide, hydrolyzed polymethacrylamide, hydrolyzed acrylamide-methacrylamide copolymers, hydrolyzed polyacrylonitrile, hydrolyzed polymethacrylonitrile, hydrolyzed acrylonitrile-methacrylonitrile copolymers, or mixtures thereof. The weight average molecular weight of the polymers is from about 500 to about 15,000 and is preferably within the range of from 750 to 10,000. Preferred polymers include polyacrylic acid, the partial sodium salt of polyacrylic acid or sodium polyacrylate having weight average molecular weights within the range of 1,000 to 10,000. These polymers are commercially available and methods for their preparation are well-known in the art.

For example, commercially available polyacrylic acids include Colloid® 204 (Colloids, Inc., Newark, N.J.); Goodrite® K-732 (B. F. Goodrich Co., Cleveland, Ohio) and PDS-76 (Economics Laboratory, Inc., St. Paul, MN). The polyacrylic acid component is preferably used in amounts of from about 0.5 to 10%, by weight of the present cleaning compositions.

Fiberglass cleaning compositions containing polycarboxylates in pace of polyacrylic acid exhibited poor soap scum and hard water deposit removal. Alternatively, substituting phosphoric acid or hydroxyacetic acid for polyacrylic acid in formulations of the present invention caused significant fiberglass discoloration within about 20 minutes.

Preferably, the cleaning composition contains about 1.0–5.0% by weight of a mixture of aminotri(methylene phosphonic acid) and a polyacrylic acid having a molecular weight of from about 1,000–10,000. It has been observed that the best combination of soap scum removal and hard water deposit removal occurs when the cleaning composition formulations incorporate about 3.5 to 6.0%, by weight of aminotri(methylene phosphonic acid) and about 3.5 to 6.0% of a polyacrylic acid having a molecular weight of about 1,000–10,000.

An important feature of the present cleaning composition is the inclusion of a higher (alkyl)betaine surfactant. The amphoteric surfactant apears to decrease the binding or penetration of the acids into the fiberglass, thereby resulting in less discoloration of the fiberglass. Betaines generally useful in the present compositions may be represented by the following structural formula:

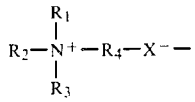

wherein $R_1$ is an alkyl radical haing from about 10–20 carbon atoms or the amido radical $RCONH(CH_2)_3$ wherein R is a $C_{10}$–$C_{20}$ alkyl radical; $R_2$ and $R_3$ are each alkyl or hyrdroxyalkyl radicals having from about 1 to 3 carbon atoms; $R_4$ is an alkylene or hydroxyalkylene radical having from 1 to 4 carbon atoms; and X is a $CO_2^-$ anion. Examples of useful betaines in the present case include higher alkyl betaines such as coco (dimethyl) carboxymethyl betaine, lauryl (dimethyl) carboxymethyl betaine, ("lauramidopropyl betaine"), lauryl (dimethyl) alpha-carboxyethyl betaine, cetyl (dimethyl) carboxymethyl betaine, lauryl bis-(2 hydroxyethyl) carboxymethyl betaine, stearyl bis-(2 hydroxyethyl) carboxymethyl betaine, oleyl dimethyl gamma-carboxypropyl betaine, lauryl, bis-(2-hydroxypropyl) alpha-carboxyethyl betaine, and the like. A preferred betaine is lauramidopropyl betaine (LMAB) commercially available from Mona Industries, Inc., Paterson, N.J. and MONATERIC® LMAB, as a 30% active aqueous solution. In comparison to the cocoamidopropyl betaines that were tried, LMAB exhibited substantially superior foaming abilities.

The amount of LMAB used in the present invention is effective to impart adequate foaming characteristics to the present compositions. An effective amount of LMAB is about 0.5 to 3% of the composition, with foaming of the cleaning composition being optimized when the LMAB surfactant is included in amounts of at least about 0.8% by weight. Preferably, amounts of LMAB in the formulations of the present invention will range from about 0.8–1.5%, by weight.

The pH of the present cleaning compositions is adjusted, if necessary, to a value within the range of about 3.0–7.0, by using an appropriate pH modifying substance. The preferred pH modifying substance is a 50% solution of an alkali metal hydroxide, e.g. sodium hydroxide. Although the cleaning composition maintains its unique ability not to discolor fiberglass at pH values as high as about 8.0, the composition is more effective to remove hard water deposits at acidic pH values. Polyacrylic acids are not stable and produce cloudy formulae at pH values below 3.5. Therefore, the preferred pH range of the present cleaning solutions is about 3.5–4.5. Accordingly, preferred cleaning solutions will comprises about 77–98.5% of water, about, 0.5–10% of a water-soluble organophosphonic acid, about 0.5–10% of a water-soluble acrylic polymer having a molecular weight of about 1,000–15,000 and, about 0.5–3.0% of lauramidopropyl betaine.

It will be appreciated that the fiberglass. cleaning compositions of the present invention can also include other additives such as thickeners and organic cosolvents, such as lower (alkyl) ethers of hydroxyalkoxyalkanols, e.g. butyl carbitol [2-(2-butoxy-ethoxy) ethanol. Furthermore, dyes, perfumes, fragrances, and the like which do not significantly affect the cleaning properties may also be included.

The present invention will be further described by the following specific Examples, which should not be used in limiting the scope of the invention. All parts given are in parts by weight, unless otherwise specifically indicated.

EXAMPLES 1–13

Table I summarizes the composition of 13 aqueous acidic compositions for cleaning fiberglass which were prepared. In each case the listed ingredients were added to distilled water in amounts appropriate to yield the final wt.—% of the active ingredients as set forth in Table I. The pH of each composition was adjusted with sodium hydroxides, if necessary, to a value of about 4.0.

TABLE 1

CLEANING COMPOSITIONS
EXAMPLE (Final Wt. % Active Ingredient)

| INGREDIENT | 1 | 2 | 3 | 4 | 5 | 6 | 7 | 8 | 9 | 10 | 11 | 12 | 13 |
|---|---|---|---|---|---|---|---|---|---|---|---|---|---|
| Kelzan ® S* | 0.05 | 0.05 | 0.05 | 0.05 | 0.05 | 0.05 | 0.05 | 0.05 | 0.05 | 0.05 | 0.05 | 0.05 | 0.05 |
| NaOH, 50% a.q. | 1.00 | 0.375 | 2.60 | 2.60 | 2.60 | 2.25 | 1.00 | 0.375 | 0.375 | 0.375 | — | — | 2.60 |
| Polyacrylic acid, (PDS-76) | 2.00 | 1.00 | 4.75 | 4.75 | 4.75 | 3.5 | 2.00 | 1.00 | 1.00 | 1.00 | — | — | 4.75 |
| Aminotri(methylene phosphonic acid) (Dequest ® 2000) | — | — | 1.50 | 1.0 | 0.5 | 0.5 | 0.5 | 1.00 | .50 | 1.50 | 1.50 | 0.5 | 4.75 |
| Butyl carbitol | 4.00 | 4.00 | 4.0 | 4.0 | 4.0 | 4.0 | 4.0 | 4.0 | 4.0 | 4.0 | 4.0 | 4.0 | 4.0 |
| Lauramidopropyl Betaine (Monateric ® LMAB) | 0.9 | 0.9 | 0.9 | 0.9 | 0.9 | 0.9 | 0.9 | 0.9 | 0.9 | 0.9 | 0.9 | 0.9 | 0.9 |
| Water | q.s | q.s | q.s | q.s | q.s | q.s | q.s | q.s | q.s | q.s | q.s | q.s | q.s |

*Xanthan gum thickener (Kelco, San Diego, Cal.).

EXAMPLES 14–19

Table II summarizes the composition of six additional aqueous acid compositions for cleaning fiberglass. In each case the listed ingredients were added to distilled water in amounts appropriate to yield the final wt.—% of the active ingredients as set forth in Table II. The pH of each composition was adjusted with sodium hydroxide, if necessary, to a value of about 4.0.

TABLE II

| CLEANING COMPOSITIONS | | | | | | |
|---|---|---|---|---|---|---|
| | EXAMPLE (WT. % ACTIVE INGREDIENT) | | | | | |
| INGREDIENT | 14 | 15 | 16 | 17 | 18 | 19 |
| Kelzan ® S | 0.05 | 0.05 | 0.05 | 0.05 | 0.05 | 0.05 |
| NaOH, 50% | 2.6 | 2.6 | 2.6 | 2.6 | 2.6 | 2.6 |
| Polyacrylic acid (Colloids ® 204) | 4.75 | 4.75 | — | — | — | — |
| Polyacrylic acid (Goodrite ® K-732) | — | — | 4.75 | 4.75 | 4.75 | 4.75 |
| Aminotri-(methylene phosphonic acid) (Dequest ® 2000) | 1.5 | 0.5 | 1.5 | 0.5 | — | 4.75 |
| Butyl carbitol | 4.0 | 4.0 | 4.0 | 4.0 | 4.0 | 4.0 |
| Lauramidopropyl betaine (Monateric ® LMAB) | 0.9 | 0.9 | 0.9 | 0.9 | 0.9 | 0.9 |
| Water | q.s | q.s | q.s | q.s | .q.s | q.s |

Examples 1–13 were each evaluated with respect to the following parameters: foaming; vertical cling; colored fiberglass discoloration; and cleaning ability measured in terms of removal of soap scum and removal of hard water deposits. The observed results are measured and reported in Table III. Further, water hardness removal and soap scum removal values for Examples 14–19 are also reported in Table III.

To prepare tiles for testing of soap scum removal a solution of 1 gram of sebum soil, 50 grams of ivory soap shavings and 500 mls of water were prepared. This mixture was sprayed onto black or brown glass, ceramic, Wenczel tiles, (available from Wenczel Tiles Co., Trenton, N.J.) at 120 degrees F° via a fine misting sprayer. This solution was alternated with well water of approximately 220 ppm hardness. Each tile was sprayed 20 times with the soap scum solution and 20 times with well water. For hard water tiles, well water of approximately 220 ppm hardness was sprayed on the tiles using a fine misting sprayer. Each tile was sprayed 40 times, and allowed to dry in between each spraying. The tiles were air dried under heat lamps.

To analyze removal of hard water deposits from the above-prepared hard water tiles, each cleaning formula was foamed onto half of each tile. The solution was allowed to remain on the tile for 30 seconds. The tile was then wiped manually with a damp sponge, once in each direction. Each tile was rinsed under gently running cold water, held in a vertical position momentarily to dry, and then allowed to air dry in a horizontal position.

To analyze removal of soap scum from the soap scum tiles, the same procedure was followed except that the solution was allowed to remain on the soap scum tiles for one minute. Tiles were graded by observers, usually four in number. The observers graded the tiles on a scale of 1–5 with 1 being 100% removal of soap scum or hard water deposits and 5 being 0% removal of the soap scum or hard water deposits.

Discoloration of fiberglass was assessed by examining Owens Corning non-gel coated colored fiberglass units obtained from Owens Corning. This fiberglass was examined because it is most susceptable to discoloration. One inch by one inch squares of linen fabric saturated with the various cleaning formulations were placed on the fiberglass surface and the results were observed after different time periods. For examination after extended time periods, the linen squares were covered with watch glasses to prevent evaporation.

Cling time relates to the time the foam remains in contact with a surface positioned at a prescribed angle of about 60 degrees from the horizontal. The time required for a given formulation to move from one line to another on the test surface was measured. In certain cases, a cleaning formulation produced no foam, excessively runny foam or blotches of foam, in these cases no measurement of cling time was made or reported in Table III.

TABLE III

| EXAMPLE | CLING TIME (SECONDS) | FOAMING | SOAP SCUM REMOVAL | HARD WATER DEPOSIT REMOVAL | FIBERGLASS DISCOLORATION |
|---|---|---|---|---|---|
| 1 | 51 | Excellent | 3.50 | 2.0 | Minimal |
| 2 | 59 | Excellent | 3.0 | 3.25 | Minimal |
| 3 | 83 | Good | 3.50 | 2.25 | Minimal |
| 4 | — | Good | 3.75 | 1.00 | Minimal |
| 5 | 83 | Excellent | 3.25 | 1.75 | Minimal |
| 6 | 58 | Excellent | 4.0 | 2.75 | Minimal |
| 7 | 49 | Excellent | 3.50 | 1.50 | Minimal |
| 8 | 56 | Excellent | 4.00 | 2.50 | Minimal |
| 9 | 45 | Excellent | 3.00 | 3.25 | Minimal |
| 10 | — | Good | 2.75 | 2.00 | Minimal |
| 11 | — | Good | 2.00 | 2.75 | Minimal |
| 12 | 41 | Excellent | 1.75 | 3.25 | Minimal |
| 13 | — | Excellent | 2.00 | 2.25 | Minimal |
| 14 | not measured | not measured | 1.50 | 3.0 | Minimal (but slightly higher than Examples 1–13 and 16–19) |
| 15 | not measured | not measured | 1.50 | 4.0 | Minimal (but slightly higher than Examples 1–13 and 16–19) |

TABLE III-continued

| EXAMPLE | CLING TIME (SECONDS) | FOAMING | SOAP SCUM REMOVAL | HARD WATER DEPOSIT REMOVAL | FIBERGLASS DISCOLORATION |
|---|---|---|---|---|---|
| 16 | not measured | not measured | 2.0 | 2.0 | Minimal |
| 17 | not measured | not measured | 1.5 | 4.0 | Minimal |
| 18 | not measured | not measured | 1.0 | 3.0 | Minimal |
| 19 | not measured | not measured | 0.5 | 2.50 | Minimal |

As indicated in Table III, cleaning compositions which included lauramidopropyl betaine in combination with varying amounts of polyacrylic acid and organophosphonic acid exhibited little or no surface discoloration of the fiberglass. The best combined cleaning ability and lack of fiberglass discoloration was exhibited in cleaning compositions including 4.75% of both the polyacrylic acid and organophosphonic acid components together with the lauramidopropyl betaine surfactant (Examples 13 and 19).

The foregoing description, Examples and data are illustrative of the invention described herein and should not be used to unduly limit the scope of the invention. Since many embodiments and variations can be made while remaining within the spirit and scope of the invention, the invention resides wholly in the claims hereinafter appended.

What is claimed is:

1. An aqueous acidic composition useful to clean fiberglass comprising a foamable solution of:

(a) water;

(b) about 0.5–10% by weight of a water-soluble organophosphonic acid;

(c) about 0.5–3.0% by weight of a higher (alkyl)-betaine surfactant having the structural formula

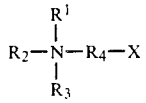

wherein $R_1$ is $C_{10}$–$C_{20}$ alkyl or $C_{10}$–$C_{20}$ alkyl amidopropyl, $R_2$ and $R_3$ are each alkyl or hydroxyalkyl radicals having from 1 to 3 carbon atoms, $R_4$ is an alkylene or hydroxyalkylene radical having from 1 to 4 carbons and X is a $CO_2$-anion; and (d) an alkaline pH modifying substance in an amount sufficient to adjust the pH value of the composition to within a range of about 3.0–7.0;

(e) wherein the higher (alkyl)-betaine surfactant in combination with the organophosphonic acid generates effective cleaning capability without substantial likelihood of discoloration.

2. The aqueous acidic composition of claim 1 wherein said alkylbetaine is lauramidopropyl betaine.

3. The aqueous acidic composition of claim 2 wherein said composition includes from about 0.8–1.5% by weight of lauramidopropyl betaine.

4. The aqueous acidic composition of claim 3, which further comprises about 0.5%–10% by weight of a water-soluble acrylic acid polymer having a molecular weight of about 1,000–15,000.

5. The aqueous acidic composition of claim 4 wherein said composition includes about 1.0–5.0% by weight of said organophosphonic acid and about 1.0–5.0% by weight of said acrylic acid polymer.

6. The aqueous acidic composition of claim 5 wherein said pH modifying substance is present in an amount effective to adjust the pH to about 3.5–4.5.

7. The aqueous acidic composition of claim 6 wherein said pH modifying substance comprises sodium hydroxide.

8. The aqueous acidic composition of claim 6 wherein said organophosphonic acid comprises aminotri(methylene phosphonic acid).

9. The aqueous acidic composition of claim 8 wherein said acrylic acid polymer comprises polyacrylic acid having a molecular weight of about 1,000–10,000.

10. An aqueous acidic composition for cleaning fiberglass comprising:

(a) water;

(b) about 0.5–10% by weight of a water-soluble acrylic acid polymer having a molecular weight of about 1,000–10,000;

(c) about 0.5–3.0% by weight of a higher (alkyl)-betaine surfactant having the structural formula

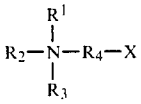

wherein $R_1$ is $C_{10}$–$C_{20}$ alkyl or $C_{10}$–$C_{20}$ alkyl amidopropyl, $R_2$ and $R_3$ are each alkyl or hydroxyalkyl radicals having from 1 to 3 carbon atoms, $R_4$ is an alkylene or hydroxyalkylene radical having from 1 to 4 carbons and X is a $CO_2$-anion; and (d) an alkaline pH modifying substance in an amount sufficient to adjust the pH value of the composition to within a range of about 3.0–7.0;

(e) wherein the higher (alkyl)-betaine surfactant in combination with the acrylic acid polymer generates effective cleaning capability without substantial likelihood of discoloration.

11. The aqueous acidic composition of claim 10 wherein said alkylbetaine is lauramidopropyl betaine.

12. The aqueous acidic composition of claim 11 wherein said composition includes from about 0.8–1.5% by weight of said lauramidopropyl betaine.

13. The aqueous acidic composition of claim 12 further comprising about 0.5–10% by weight of a water-soluble organic phosphonic acid.

14. The aqueous acidic composition of claim 13 wherein said composition includes about 1.0–5.0% by weight of said organophosphonic acid and about 1.0–5.0% by weight of said acyrlic acid polymer.

15. The aqueous acidic composition of claim 14 wherein said pH modifying substance is added in an amount sufficient to adjust the pH value to about 3.5–4.5.

16. The aqueous acidic compostion of claim 15 wherein said pH modifying substance comprises sodium hydroxide.

17. The aqueous acidic composition for cleaning fiberglass according to claim 16 wherein said organophosphonic acid comprises aminotri(methylene phosphonic acid).

18. An aqueous acidic composition for cleaning fiberglass comprising:

(a) water;

(b) about 0.5–10% by weight of a water-soluble organophosphonic acid;

(c) about 0.5–10% by weight of a water-soluble acrylic acid polymer having a molecular weight of about 1,000–15,000;

(d) about 0.5–3.0% by weight of lauramidopropyl betaine; and (e) an alkaline pH modifying substance in an amount sufficient to adjust the pH of the composition to a value within the range of about 3.0–7.0;

(f) wherein the lauramidopropyl betaine in combination with the organophosphonic acid and acrylic acid polymer generates effective cleaning capability without substantial likelihood of discoloration.

19. The aqueous acidic composition of claim 18 wherein said composition includes about 1.0–5.0% by weight of said phosphonic acid and about 1.0–5.0% by weight of said acrylic acid polymer.

20. The aqueous acid composition of claim 18 wherein said composition includes about 0.8–1.5% by weight of said lauramidopropyl betaine.

21. The aqueous acidic composition of claim 20 wherein said composition includes about 3.5–6.0% by weight of said organophosphonic acid and about 3.5–6.0% by weight of said acrylic acid polymer.

22. The aqueous acidic composition of claim 21 wherein said pH modifying substance is added in an amount sufficient to adjust the pH to about 3.5–4.5.

23. The aqueous acidic composition of claim 22 wherein said pH modifying substance comprises sodium hydroxide.

24. The aqueous acidic composition of claim 23 wherein said organophosphonic acid comprises aminotri(methylene phosphonic acid).

25. The aqueous acidic composition of claim 24 wherein said acrylic acid polymer comprises a polyacrylic acid having a molecular weight of about 1,000–10,000.

26. An aqueous acidic composition for cleaning fiberglass comprising (a) water;

(b) about 3.5–6.0% by weight of a water-soluble organophosphonic acid;

(c) about 3.5–6% by weight of a polyacrylic acid having a molecular weight of about 1,000–10,000;

(d) about 0.8–1.5% by weight of lauramidopropyl betaine; and (e) an alkaline pH modifying substance in an amount sufficient to adjust the pH value of the composition to within a range of about 3.0–4.5;

(f) wherein the lauramidopropyl betaine in combination with the organophosphonic acid and acrylic acid polymer generates effective cleaning capability without substantial likelihood for discoloration.

27. An aqueous acid composition for cleaning fiberglass according to claim 26 wherein the pH is adjusted with sodium hydroxide.

* * * * *